US006599108B2

(12) United States Patent
Yamashita

(10) Patent No.: US 6,599,108 B2
(45) Date of Patent: Jul. 29, 2003

(54) VACUUM PUMP

(75) Inventor: Yoshihiro Yamashita, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/997,482

(22) Filed: Nov. 21, 2001

(65) Prior Publication Data

US 2002/0090309 A1 Jul. 11, 2002

(30) Foreign Application Priority Data

Nov. 22, 2000 (JP) ..... 2000-356377

(51) Int. Cl.[7] ..... F04B 17/00

(52) U.S. Cl. ..... 417/423.4; 417/423.14; 417/423.7; 417/313; 417/423.8; 417/423.1

(58) Field of Search ..... 417/423.4, 423.14, 417/423.7, 313, 423.8, 423.1

(56) References Cited

U.S. PATENT DOCUMENTS 4,904,155 A * 2/1990 Nagaoka et al. ..... 415/90
4,926,648 A * 5/1990 Okumura et al. ..... 62/55.5
5,779,453 A * 7/1998 Nagayama et al. ..... 417/410.4
5,879,139 A * 3/1999 Hayashi et al. ..... 417/292
6,022,195 A * 2/2000 Gaudet et al. ..... 417/27

* cited by examiner

*Primary Examiner*—Charles G. Freay
*Assistant Examiner*—Michael K. Gray
(74) *Attorney, Agent, or Firm*—Adams & Wilks

(57) ABSTRACT

A vacuum pump comprises a pump case having an interior space, a rotor disposed in the interior space of the pump case, and a thread stator disposed in the interior space of the pump case and opposite to an outer peripheral surface of the rotor. At least one heater is arranged in the thread stator for heating the interior space of the pump case. An output device outputs a parameter constituting a factor for determining a temperature of the rotor. A memory stores a database containing information corresponding to a relationship between the parameter output by the output device and a preselected temperature of the heater. A controller inputs the parameter output by the output device and selects from the database stored in the memory the preselected temperature of the heater in accordance with the input parameter.

28 Claims, 3 Drawing Sheets

VACUUM PUMP

BACKGROUND OF THE INVENTION

1. Field of the Invention

The present invention relates to a vacuum pump used in, for example, a semiconductor manufacturing apparatus, an electron microscope, a surface analysis apparatus, a mass spectrograph, a particle accelerator, and a nuclear fusion experiment apparatus.

2. Description of the Related Art

Semiconductor manufacturing involves processes, such as dry etching and CVD, and these processes are conducted in a vacuum vessel called a process chamber. A gaseous product generated during such a process (hereinafter referred to as "product gas") is discharged to the exterior through a vacuum pump mounted to the vacuum vessel. Depending on a relationship between temperature and pressure inside the vacuum pump, some product gases can be solidified or liquefied inside the vacuum pump. In some cases, the solidified or liquefied product adheres to or is accumulated in the interior of the vacuum pump, preventing normal operation of the vacuum pump.

In the case of a vacuum pump used in processes such as dry etching and CVD, a band heater, for example, is conventionally attached to the outer periphery of the pump case of the vacuum pump in order to prevent adhesion and accumulation of the product, warming the vacuum heater by using this band heater.

However, in the case of a vacuum pump such as a turbo-molecular pump, in which gas is exhausted through rotation of a rotor, the rotor temperature cannot be made so high in view of a relationship among the specific strength, high-temperature creep, etc. of the materials for the rotor and the rotor blades integrally formed on the outer peripheral surface of the rotor. Thus, the temperature of the band heater has to be set relatively low, so that it is impossible to sufficiently prevent adhesion and accumulation of the product inside the vacuum pump.

SUMMARY OF THE INVENTION

The present invention has been made with a view toward solving the above problem. It is an object of the present invention to provide a vacuum pump capable of effectively preventing adhesion and accumulation of the product inside the pump while appropriately controlling the rotor temperature.

To achieve the above object, there is provided, in accordance with the present invention, a vacuum pump equipped with a pump mechanism portion for discharging gas from a vacuum vessel through rotation of a rotor installed in a pump case, a heater for warming the interior of the pump case, and a water-cooling tube for cooling the pump case, characterized in that it includes: a send-out means for sending out a parameter constituting a factor determining the temperature of the rotor; and a memory for storing the relationship between the parameter and the set temperature of the heater as a database, and characterized in that when the parameter sent out from the send-out means is input, the set temperature of the heater is determined from the database in the memory on the basis of the input parameter.

It is possible to adopt an arrangement in which the send-out means obtains and sends out as the parameter at least one of the following items of information consisting of pump ambient air temperature, the temperature and flow rate of pump cooling water, the kind and flow rate of pump evacuation gas, and pump exhaust pressure.

DETAILED DESCRIPTION OF THE PREFERRED EMBODIMENT

A vacuum pump according to an embodiment of the present invention will be described in detail with reference to FIGS. 1 through 3.

Figure 1:
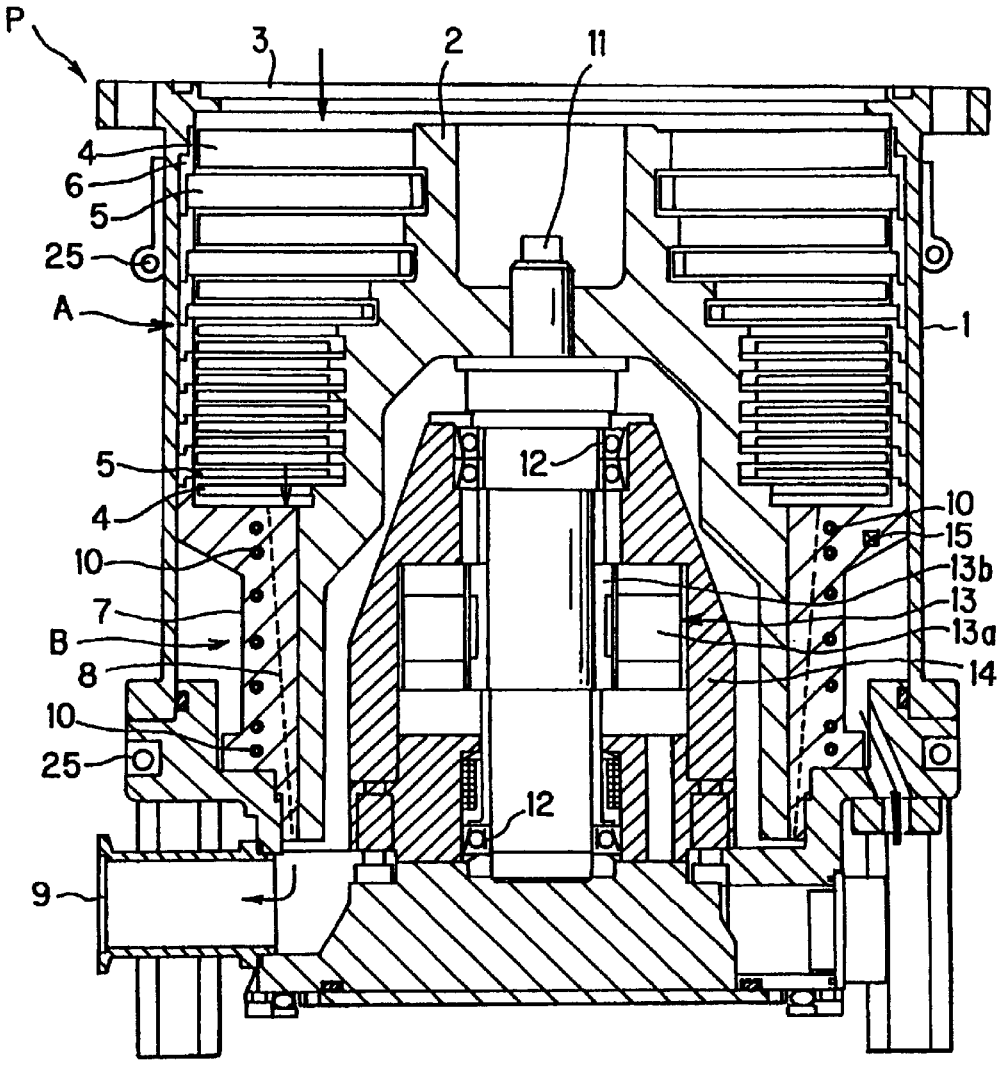
FIG. 1 is a sectional view showing a vacuum pump according to an embodiment of the present invention.

FIG. 1 shows a vacuum pump P according to this embodiment, which has a cylindrical pump case 1 containing a pump mechanism portion including a rotatably installed cylindrical rotor 2 whose upper end is directed to a gas inlet 3 side in the upper portion of the pump case 1. The pump case 1 also includes a base at the bottom of it.

In the case of the present vacuum pump P, the upper half of the rotor 2 functions as a turbo-molecular pump, and the lower half of the rotor 2 functions a thread groove pump.

First, the construction of the upper half of the rotor 2 serving as a turbo-molecular pump will be described. In the outer periphery of the upper portion of the rotor 2, there are provided a plurality of processed rotor blades 4 and stator blades 5. The rotor blades 4 and the stator blades 5 are alternately arranged along a rotation center axis of the rotor 2. Thus, in the outer periphery of the upper portion side of the rotor 2, the stator blades 5 are arranged between the upper and lower rotor blades 4, 4, or the upper and lower rotor blades 5, 5 are arranged between the stator blades 5.

The rotor blades 4 are integrally provided on the outer peripheral surface of the upper portion side of the rotor 2 and are capable of rotating integrally with the rotor 2, whereas the stator blades 5 are fixed to the inner surface of the pump case 1 through the intermediation of spacers 6.

Next, the construction of the lower half of the rotor 2 functioning as a thread groove pump will be described. A thread stator 7 is arranged so as to be opposed to the outer periphery of the lower portion of the rotor 2. The thread stator 7 is formed as a cylinder surrounding the outer periphery of the lower portion side of the rotor 2 and is fixed onto the inner wall side of the pump case 1.

A thread groove 8 is formed in the thread stator 7, and the thread groove 8 is provided on the side of the thread stator 7 opposed to the rotor.

The upper portion of the thread stator 7 is constructed so as to be in contact with the lowermost stator blade 5, and the lower portion of the thread stator 7 is constructed so as to be in contact with a gas outlet 9 in the lower portion of the pump case 1.

Of the internal components of the vacuum pump P, the thread stator 7 has the greatest heat capacity, and this thread stator 7 with great heat capacity contains sheath heaters 10 well known as heating means and a temperature sensor 15.

The sheath heaters 10 are used as a means for warming the interior of the pump casing, and the temperature sensor 15 is positioned in the vicinity of the sheath heaters 10 and is provided as a means for detecting current heater temperature.

The sheath heaters 10 and the temperature sensor 15 as described above may be contained in the thread stator 7 by various systems. For example, (1) the sheath heaters 10 and the temperature sensor 15 may be directly embedded in the thread stator 7, or (2) recesses for installing the heaters and for installing the sensors may be provided in the thread stator 7, the sheath heaters 10 and the temperature sensor 15 being fitted into these recesses.

In the case of the system (1), when, for example, preparing the thread stator 7 by die-casting, the sheath heater 10 may be placed in the die.

While it is possible for the sheath heaters 10 in the thread stator 7 to be arranged uniformly throughout from the upper to the lower portion of the thread stator 7, this embodiment adopts a structure in which the sheath heaters 10 are arranged more densely in the upper and lower portions of the thread stator 7. This variation in the arrangement density of the sheath heaters 10 is effected in order that the entire thread stator 7 may be uniformly heated.

That is, the upper and lower portions of the thread stator 7 have a heat radiation property better than the central portion thereof, which means the temperature in the upper and lower portions of the thread stator 7 is likely to be particularly low. Thus, in this embodiment, the sheath heaters 10 are arranged densely in the upper and lower portions of the thread stator 7, whereby heat conduction is effected actively in the stator blades 5 in the upper portion and the gas outlet 9 in the lower portion of the pump case 1, thereby reducing as much as possible the variation in temperature in the evacuation gas passage in the pump and uniformly heating the entire thread stator 7.

Next, the inner construction of the rotor 2 will be described. Inside the rotor 2, a rotor shaft 11 is integrally mounted so as to be in the rotation axis thereof. Various types of bearing may be adopted as a bearing means of this rotor shaft 11. In this embodiment, the rotor shaft 11 is supported by ball bearings 12.

The rotor shaft 11 is rotated by a driving motor 13. The driving motor 13 is constituted by a motor stator 13*a* mounted to a stator column 14 installed inside the rotor 2, and a motor rotor 13*b* arranged on the outer peripheral surface of the rotor shaft 11 so as to be opposed to the motor stator 13*a*.

Figure 2:
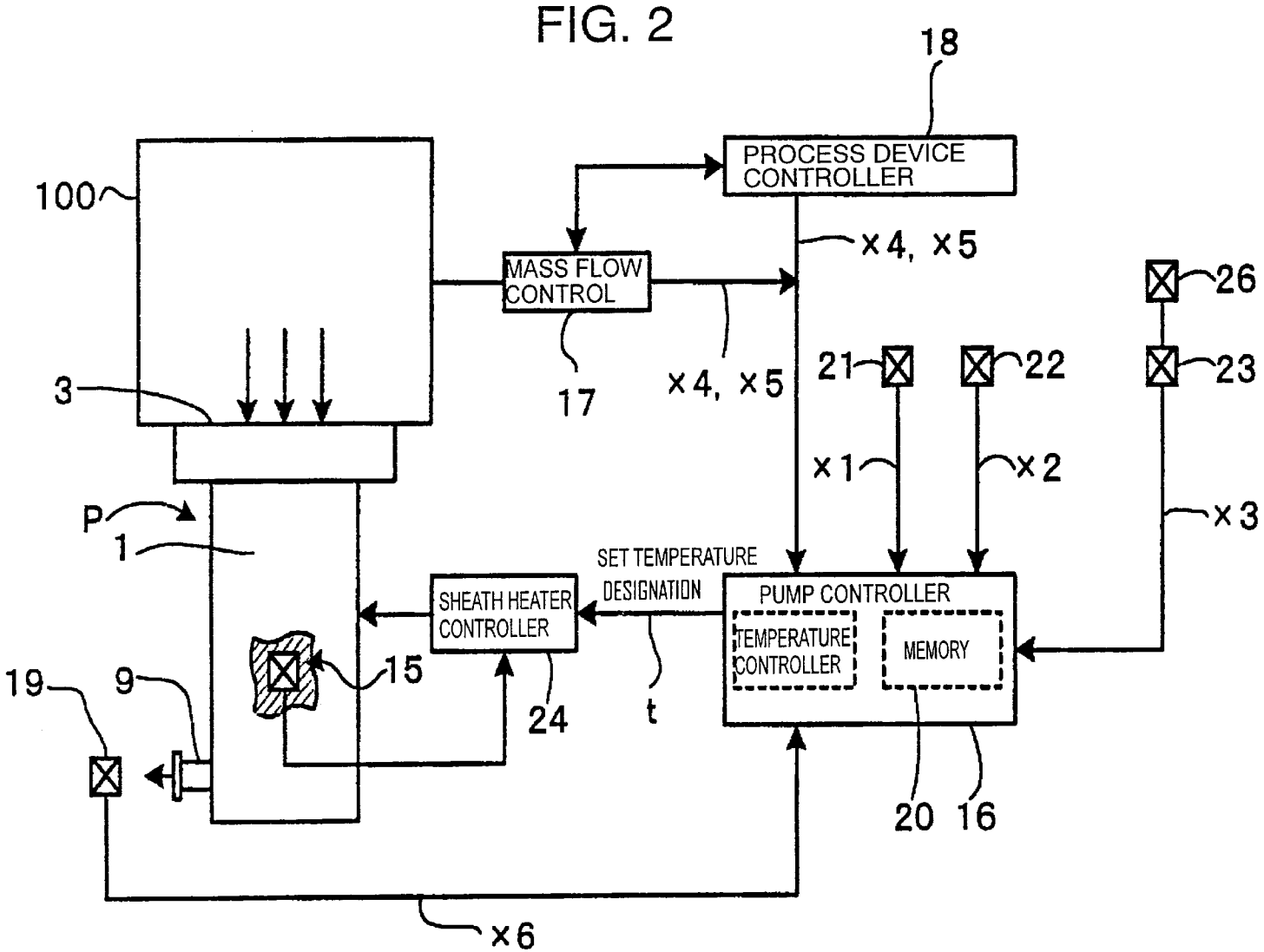
FIG. 2 is a schematic diagram illustrating the control system of the vacuum pump shown in FIG. 1 and an evacuation system for the vacuum vessel using the same.

As shown in FIG. 2, the gas inlet 3 in the upper portion of the pump case 1 as described above is connected to a high-vacuum chamber 100 which is, for example, the process chamber of a semiconductor manufacturing apparatus, and the gas outlet 9 in the lower portion of the pump case 1 is arranged so as to communicate with the low pressure side.

Thus, in this vacuum pump P, the turbo-molecular mechanism portion A effecting evacuation through mutual action of the rotating rotor blades 4 and the stationary stator blades 5 is positioned on the high-vacuum side, and the thread groove pump mechanism B effecting evacuation through a mutual action of the rotor 2 and the thread groove 8 is positioned on the low pressure side.

In the turbo-molecular pump mechanism portion A, gas molecules are discharged through a mutual action of the rotating rotor blades 4 and the stationary stator blades 5. By this evacuating operation, it is possible to obtain a high vacuum (vacuum degree: $10^{-6}$ Pa).

The pump case 1 is equipped with a water-cooling tube 25, and the vacuum pump P is cooled by cooling water flowing through this water-cooling pump 25. The flow rate of the cooling water is controlled by an automatic valve 26.

In the vacuum pump P, constructed as described above, it has been confirmed based on data that the temperature reached during the rotation of the rotor 2 varies depending on the following factors (1) through (5).

(1) Ambient temperature X1 of the vacuum pump P (hereinafter referred to as the "pump ambient temperature").

(2) The temperature X2 and flow rate X3 of the cooling water of the vacuum pump P.

(3) The kind of gas X4 exhausted by the vacuum pump P (hereinafter referred to as "pump exhaust gas").

(4) The flow rate X5 of the exhaust gas.

(5) The evacuation side pressure X6 of the vacuum pump P (hereinafter referred to as the "pump exhaust pressure").

Thus, the pump ambient temperature X1, the temperature X2 and flow rate X3 of the pump cooling water, the kind X4 and flow rate X5 of the pump exhaust gas, and the pump exhaust pressure X6 constitute parameters determining the temperature of the rotor 2, respectively. This embodiment adopts a system in which all the parameters (X1 through X6) are transmitted to a pump controller 16.

As shown in FIG. 2, pieces of information on the pump ambient temperature X1, and the temperature X2 and flow rate X3 of the pump cooling water are respectively detected by an ambient temperature sensor 21, a cooling water temperature sensor 22, and a cooling water flow rate sensor 23 consisting of a flowmeter, and sent out to the pump controller 16.

Information on the kind X4 and flow rate X5 of the pump exhaust gas may be directly sent out to the pump controller 16 from a mass flow control 17 (hereinafter abridged as "MFC") or sent out to the pump controller 16 from a controller 18 of a process device controlling the MFC 17.

Information on the pump exhaust pressure X6 is detected by an exhaust pressure sensor 19 provided in the vicinity of the gas outlet 9 in the lower portion of the pump case 1 and sent out to the pump controller 16.

Thus, in this embodiment, the ambient temperature sensor 21, the cooling water temperature sensor 22, the MFC 17, the controller 18 of the process device, the exhaust pressure sensor 19, etc. function as send-out means for the various parameters (X1 through X6) determining the temperature of the rotor 2.

The MFC 17 is provided as a means for controlling the process pressure in the vacuum vessel 100 constituting the process chamber of a semiconductor manufacturing apparatus. For example, when it is necessary to increase the pressure in the vacuum vessel 100, a pressure control gas, such as nitrogen gas, is introduced into the vacuum vessel 100 through the MFC 17. At this time, the MFC 17 controls the amount of such pressure control gas introduced, thereby controlling the pressure in the vacuum vessel 100.

Thus, the MFC 17 and the process device controller 18 controlling the same have information regarding what kind of gas in what amount is being introduced into the vacuum vessel 100 and exhausted by the vacuum pump P.

Thus, in this embodiment, pieces of information on the kind X4 of pump exhaust gas and the flow rate X5 thereof are obtained from the MFC 17 and the process device controller 18 controlling the same, etc., and the information (the kind X4 of pump exhaust gas and the flow rate X5 thereof) is sent out from the MFC 17 or the process device controller 18 controlling the same to the pump controller 16.

In the above-mentioned pump controller 16, there is provided a memory 20 consisting of a RAM, ROM or the like, and the relationship between the above various parameters (X1 through X5) and the set temperature t of the sheath heaters 10 is stored in the memory 20 as a database.

Further, the pump controller 16 performs pump control operations in general, such as the controlling of the speed of rotation of the vacuum pump P, and determines and indicates the set temperature t of the sheath heaters 10.

That is, when the various parameters (X1 through X6) are input to the pump controller 16, the pump controller 16 determines the set temperature t of the sheath heaters 10 on the basis of the input parameters (X1 through X6) from the database in the memory 20, and instructs the controller 24 for the sheath heaters 10 to set the temperature to this set temperature t.

In the vacuum pump P constructed as described above, the rotor 2 and the rotor blades 4 are usually formed of a lightweight alloy. Taking into account the specific strength, high-temperature creep, etc. of the material, the sheath heaters 10 for heating should be set to a temperature as low as possible. However, when the set temperature t is set to a too low level, the temperature of the rotor 2 does not rise, with the result that the effect of preventing adhesion and accumulation of product is deteriorated. Thus, there are upper and lower limits to the heating temperature of the rotor 2. For example, when the rotor 2 rotating at a circumferential speed of 400 m/s is formed of an aluminum alloy, it is desirable to use it at a temperature of not higher than 140° C. Thus, in this example, the range of the set temperature t of the sheath heater 10 is determined taking into consideration the vapor pressure chart of the used gas and the produced gas.

The controller 23 for the sheath heaters 10 compares the designated set temperature t with the current sheath heater temperature detected by the temperature sensor 15, and performs control such that the current sheath heater temperature becomes equal to the set temperature t.

Next, an example of use and the operation of the vacuum pump P constructed as described above will be described with reference to FIGS. 1 and 2. In the drawings, the arrows indicate the flow directions of the exhaust gas in the vacuum pump P.

The vacuum pump P shown in the figures can be used, for example, as a means for evacuating the vacuum vessel 100 (process chamber) of the semiconductor manufacturing apparatus. In the case of this example, the gas inlet 3 of the pump case 1 of the vacuum pump P is connected to the vacuum vessel 100 side.

In the vacuum pump P thus connected, an auxiliary pump (not shown) connected to the gas outlet 9 is operated, and evacuation of the vacuum vessel 100 is effected up to on the order of $10^{-1}$ Torr. Thereafter, when an operation starting switch (not shown) is turned on, the driving motor 13 operates, and the rotor 2 and the rotor blades 4 rotate integrally with the rotor shaft 11.

In this case, the gas molecule evacuating operation in the turbo-molecular pump mechanism portion A is conducted as follows. The uppermost rotor blade 4 imparts a downward momentum to the gas molecule group entering through the gas inlet 3, and the gas molecules with this downward momentum are guided by the stator blade 5 to be transferred to the next lower rotor blade 4 side. By repeating this imparting of momentum, the gas molecules are transferred from the gas inlet 3 toward the thread groove 8 side and discharged.

The gas molecules reaching the thread groove 8 side are compressed by an intermediate flow and transferred to the gas outlet 9 side, and discharged to the exterior of the pump through the gas outlet 9 by an auxiliary pump (not shown).

In this vacuum pump P also, the discharged gas also contains a gaseous product generated in the process, and depending on the kind of the product gas, from the relationship between temperature and pressure in the vacuum pump P, the gas can solidify or liquefy in the vacuum pump P and adhere or accumulate inside the vacuum pump. When there is the possibility of adhesion or accumulation of the product, a heater operating switch (not shown) is turned on, thereby causing the sheath heaters 10 to generate heat.

At this time, the set temperature t of the sheath heaters 10 is determined and designated by the pump controller 16. Here, the method of determining and designating the set temperature t will be described. First, information on the pump ambient temperature X1 is sent out from an ambient temperature sensor 21, information on the pump cooling water temperature X2 is sent out from a cooling water temperature sensor 22, information on the pump cooling water flow rate X3 is sent out from a cooling water flow rate sensor 23, information on the kind X4 and flow rate X5 of the pump exhaust gas is sent out from the MFC 17 or the process device controller 18, and information on the pump exhaust pressure X6 is sent out from the exhaust pressure sensor 19, respectively. Then, the various parameters (X1 through X6) thus sent out are input to the pump controller 16.

Then, in the pump controller 16, the database in the memory 20 is referred to on the basis of the input parameters (X1 through X5), and the set temperature t of the sheath heaters 10 is determined from the database. The set temperature t thus determined is transmitted from the pump controller 16 to the controller 24 of the sheath heaters 10, whereby the sheath heaters 10 generate heat so as to achieve the set temperature t.

When the sheath heaters 10 generate heat at the set temperature t designated as described above, the thread stator 7 is directly heated by the sheath heaters 10, and the spacer 6 and the stator blade 5 in contact with the upper portion side of the thread stator 7 and the gas outlet 9 in contact with the lower portion of the thread stator 7 are both warmed by thermal conduction, whereby the adhesion and accumulation of product on the rotor 2, thread stator 7, the stator blades 5, and the gas outlet 9 are prevented.

As described above, the vacuum pump P of this embodiment employs such a structure that the set temperature t of the sheath heaters 10 is determined from the database in the memory 20 on the basis of the parameters (X1 through X6) constituting the temperature determining factors of the rotor 2, so that it is possible to effectively prevent the product adhesion and accumulation inside the pump while appropriately controlling the temperature of the rotor 2, whereby it is possible to eliminate pump failure attributable to breakage of the rotor 2, the rotor blades 4, etc. due to thermal fatigue and product adhesion and accumulation, thereby elongating the service life of the vacuum pump P.

Figure 3:
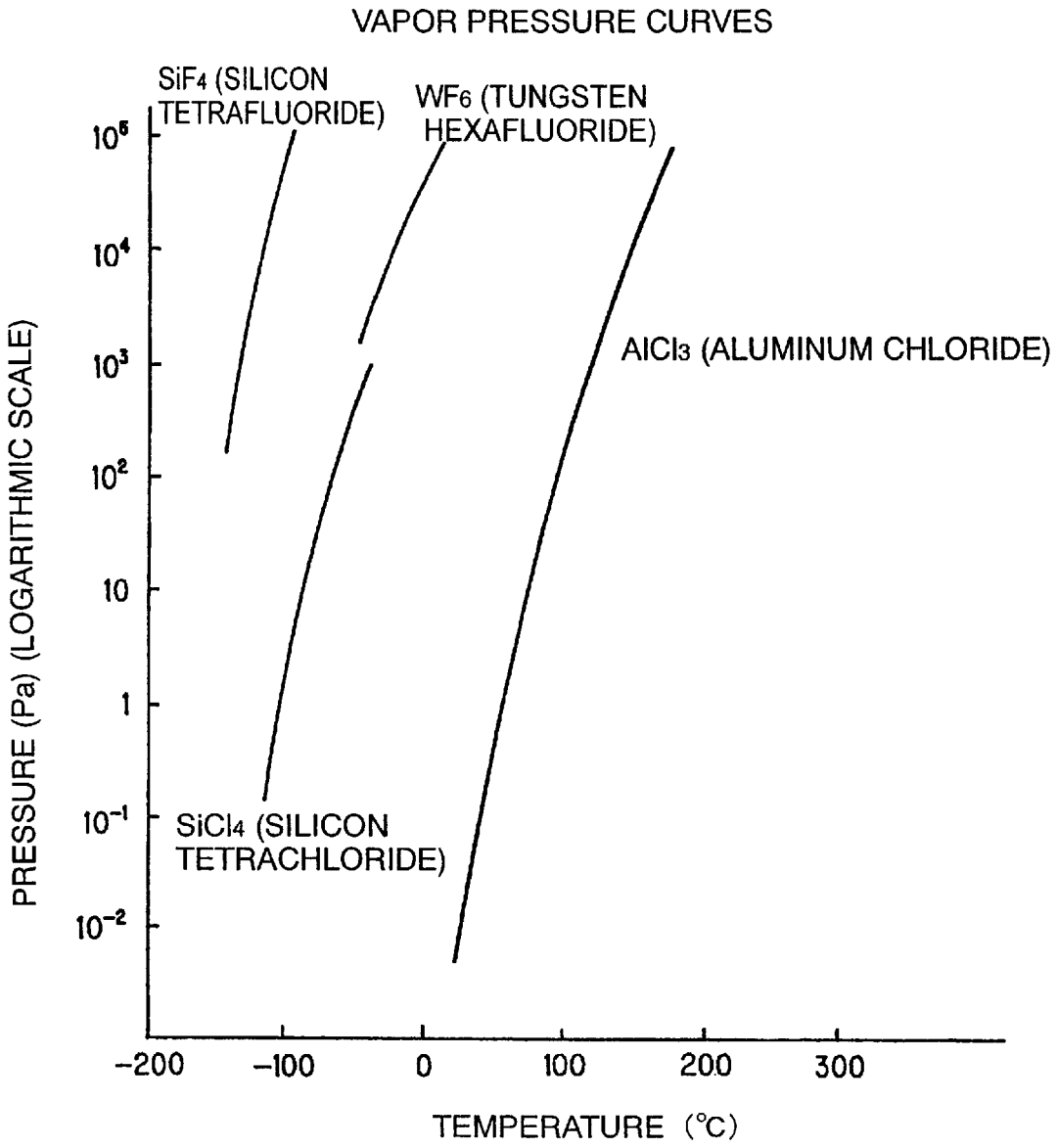
FIG. 3 is a chart showing vapor pressure curves of exhaust gases.

FIG. 3 shows vapor pressure curves of four kinds of exhaust gases (silicon tetrafluoride, tungsten hexafluoride, silicon tetrachloride, and aluminum chloride). On the right-hand side of each vapor pressure curve, the gas is in a gaseous state, and on the left-hand side thereof, it is in a solid or liquid state. The vapor pressure curves show that each of the four kinds of exhaust gases is changed from the gaseous to the solid or liquid state when the pressure increases.

In the case of the present vacuum pump P, in the vicinity of the gas inlet 3, the exhaust gas is not easily changed to a solid product since the pump portion is near the high-vacuum side and the pressure in the portion is low, whereas the pressure gradually increases from the uppermost stator blade 5 toward the thread stator 7. Thus, in the vicinity of the stator blade 5 and the rotor blade 4 adjacent to the thread stator 7, the thread groove 8 of the thread stator 7 and the outer peripheral surface of the rotor 2 opposed thereto, and the gas outlet 9, the exhaust gas is likely to be changed to a solid product. Taking into consideration, for example, this inner condition of the vacuum pump P and the fact that the thread stator 7 is a pump component with maximum heat capacity in the vacuum pump P, the thread stator 7 is provided with the sheath heaters 10 in the vacuum pump P of this embodiment, as described above. Thus, in the vacuum pump P of this embodiment, the thread stator 7, which is readily subjected to the adhesion and accumulation of product, is directly heated by the sheath heaters 10, whereby it is possible to achieve a reduction in the requisite energy for heating and an improvement in terms of responsiveness in heating operation and controllability.

Further, the vacuum pump P of this embodiment employs such a structure that the sheath heaters 10 are directly embedded or fitted in the thread stator 7, so that it is possible to increase the input power density per unit length, making it possible to achieve a further improvement in terms of responsiveness in heating operation and controllability. Further, it is also possible to meet the need for a high-temperature heating of 100° C. or more, which could not be realized by the conventional band heater, thus making it also possible to increase the heating temperature.

Further, the vacuum pump P of this embodiment adopts a structure in which the lowermost stator blade 5 and the gas outlet 9 are in direct contact with the thread stator 7, so that the stator blade 5 and the rotor blade 4 in the vicinity of the thread stator 7 and the gas outlet 9 are also heated by thermal conduction, whereby it is possible to effectively prevent the product adhesion to and accumulation in the gas outlet 9, etc.

The present invention is applicable not only to the structure of the above embodiment, which uses the sheath heaters 10 built in the pump, but also to a structure which has a band heater attached to the outer periphery of the pump case.

It is also possible for the thread groove 8 of the above embodiment to be provided on the rotor 2 side instead of on the thread stator 7 side. In this case, the thread groove 8 is formed in the outer peripheral surface of the rotor 2 opposed to the thread stator 7.

Regarding the bearing means for the rotor shaft 11 of the above embodiment, it is also possible to use non-contact type bearings, such as magnetic bearings, instead of the above-described ball bearings 12.

As described above, the vacuum pump according to the present invention adopts an arrangement in which the set temperature of the sheath heaters is determined from a database in memory on the basis of parameters constituting factors determining the rotor temperature, so that it is possible to effectively prevent product adhesion and accumulation inside the pump while appropriately controlling the rotor temperature, whereby it is possible to eliminate breakage of the rotor and rotor blades due to thermal fatigue and pump failure due to product adhesion and accumulation, thereby making it possible to elongate the service life of a vacuum pump of this type.

What is claimed is:

1. A vacuum pump comprising:

a pump case having an interior space;

a rotor disposed in the interior space of the pump case;

a thread stator disposed in the interior space of the pump case and opposite to an outer peripheral surface of the rotor;

a thread groove formed in one of the thread stator and the rotor;

at least one heater disposed in the thread stator for heating the interior space of the pump case;

send-out means for sending out a parameter constituting a factor for determining a temperature of the rotor;

a memory for storing a database containing information corresponding to a relationship between the parameter sent out from the send-out means and a preselected temperature of the heater; and control means for inputting the parameter sent out by the send-out means and for selecting from the database stored in the memory the preselected temperature of the heater in accordance with the input parameter.

2. A vacuum pump according to claim 1; wherein the parameter sent out by the send-out means comprises information information corresponding to the ambient air temperature of the vacuum pump.

3. A vacuum pump according to claim 1; wherein the parameter sent out by the send-out means comprises information corresponding to the type and flow rate of evacuation gas of the vacuum pump.

4. A vacuum pump according to claim 1; wherein the parameter sent out by the send-out means comprises information corresponding to an exhaust pressure of the vacuum pump.

5. A vacuum pump according to claim 1; further comprising a water-cooling tube for cooling the pump case.

6. A vacuum pump according to claim 5; wherein the parameter sent out by the send-out means comprises information corresponding to the temperature and flow rate of cooling water flowing through the water-cooling tube.

7. A vacuum pump according to claim 1; wherein the at least one heater comprises a plurality of heaters arranged densely in upper and lower portions of the thread stator.

8. A vacuum pump according to claim 7; wherein the heaters are arranged more densely in the upper and lower portions of the thread stator than in a portion thereof disposed between the upper and lower portions.

9. A vacuum pump according to claim 1; wherein the thread groove is formed in the thread stator.

10. A vacuum pump according to claim 1; further comprising a gas inlet through which a gas is pumped into the pump case and a gas outlet for discharging the gas from the pump case, the gas outlet being disposed in contact with the thread stator.

11. A vacuum pump according to claim 10; further comprising a plurality of stator blades mounted on an inner surface of the pump case, one of the stator blades being disposed in contact with the thread stator.

12. A vacuum pump according to claim 11; wherein the gas outlet and the stator blade are each disposed in direct contact with the thread stator and are heated by thermal conduction when the thread stator is directly heated by the heater.

13. A vacuum pump according to claim 1; further comprising a plurality of stator blades mounted on an inner surface of the pump case, one of the stator blades being disposed in contact with the thread stator.

14. A vacuum pump comprising:

a pump case having an interior space;

a rotor disposed in the interior space of the pump case;

a thread stator disposed in the interior space of the pump case and opposite to an outer peripheral surface of the rotor;

at least one heater disposed in the thread stator for heating the interior space of the pump case;

output means for outputting at least one parameter constituting a factor for determining a temperature of the rotor; and control means for determining a temperature of the heater in accordance with the parameter output from the output means.

15. A vacuum pump according to claim 14; wherein the at least one parameter comprises a plurality of parameters each constituting a different factor for determining the preselected temperature of the rotor; and wherein the control means includes means for determining the temperature of the heater in accordance with the parameters.

16. A vacuum pump according to claim 15; wherein the parameters output from the output means comprise information corresponding to ambient air temperature of the vacuum pump, temperature and flow rate of cooling water for cooling the pump case, type and flow rate of evacuation gas of the vacuum pump, and exhaust pressure of the vacuum pump.

17. A vacuum pump according to claim 14; wherein the parameter output from the output means comprises one of information corresponding to ambient air temperature of the vacuum pump, temperature and flow rate of cooling water for cooling the pump case, type and flow rate of evacuation gas of the vacuum pump, and exhaust pressure of the vacuum pump.

18. A vacuum pump according to claim 14; wherein the at least one heater comprises a plurality of heaters arranged in the thread stator.

19. A vacuum pump according to claim 18; wherein the heaters are arranged densely in upper and lower portions of the thread stator.

20. A vacuum pump according to claim 19; wherein the heaters are arranged more densely in the upper and lower disposed of the thread stator than in a portion thereof between the upper and lower portions.

21. A vacuum pump according to claim 14; further comprising a gas inlet through which a gas is pumped into the pump case and a gas outlet for discharging the gas from the pump case, the gas outlet being disposed in contact with the thread stator.

22. A vacuum pump according to claim 21; further comprising a plurality of stator blades mounted on an inner surface of the pump case, one of the stator blades being disposed in contact with the thread stator.

23. A vacuum pump according to claim 22; wherein the gas outlet and the stator blade are each disposed in direct contact with the thread stator and are heated by thermal conduction when the thread stator is directly heated by the heater.

24. A vacuum pump according to claim 14; further comprising a plurality of stator blades mounted on an inner surface of the pump case, one of the stator blades being disposed in contact with the thread stator.

25. A vacuum pump comprising:

a case having an interior space;

a gas inlet through which a gas is pumped into the interior space of the case;

a gas outlet for discharging the gas from the interior space of the case;

a rotor disposed between the gas inlet and the gas outlet;

a stator disposed in the interior space of the case and having a plurality of stator blades disposed opposite to an outer peripheral surface of the rotor;

a thread stator disposed in the interior space of the case in contact with the gas outlet and one of the stator blades; and at least one heater disposed in the thread stator for directly heating the thread stator to thereby heat the gas outlet and the stator blade by thermal conduction.

26. A vacuum pump according to claim 25; wherein the at least one heater comprises a plurality of heaters arranged in the thread stator.

27. A vacuum pump according to claim 26; wherein the heaters are arranged densely in upper and lower portions of the thread stator.

28. A vacuum pump according to claim 27; wherein the heaters are arranged more densely in the upper and lower portions of the thread stator than in a portion thereof disposed between the upper and lower portions.

* * * * *